US009833916B2

(12) United States Patent
Shorey et al.

(10) Patent No.: US 9,833,916 B2
(45) **Date of Patent: *Dec. 5, 2017**

(54) DISPOSABLE FLUID DISPENSING RESERVOIR

(71) Applicant: The Gillette Company, Boston, MA (US)

(72) Inventors: Anthony William Shorey, Thatcham (GB); Nicola Louise Caton, Reading (GB); Christopher Martin Hawes, Reading (GB)

(73) Assignee: The Gillette Company LLC, Boston, MA (US)

( * ) Notice: Subject to any disclaimer, the term of this patent is extended or adjusted under 35 U.S.C. 154(b) by 229 days.

This patent is subject to a terminal disclaimer.

(21) Appl. No.: 14/753,216

(22) Filed: Jun. 29, 2015

(65) Prior Publication Data

US 2015/0375407 A1 Dec. 31, 2015

(30) Foreign Application Priority Data

Jun. 30, 2014 (EP) ..... 14175102
Jun. 22, 2015 (EP) ..... 15173129

(51) Int. Cl.
*B26B 21/44* (2006.01)
*B65D 75/58* (2006.01)
(Continued)

(52) U.S. Cl.
CPC ..... *B26B 21/44* (2013.01); *B26B 21/446* (2013.01); *B65D 47/42* (2013.01); *B65D 75/58* (2013.01); *B65D 83/0055* (2013.01)

(58) Field of Classification Search
CPC ..... B26B 21/44; B26B 21/446; B65D 47/42; B65D 83/0055; B65D 75/58
(Continued)

(56) References Cited

U.S. PATENT DOCUMENTS 1,453,014 A * 4/1923 Kohn ..... A46B 15/0055 132/290
1,985,132 A 12/1934 Woods
(Continued)

FOREIGN PATENT DOCUMENTS

DE 102011117590 5/2013
DE 102012018501 3/2014
(Continued)

OTHER PUBLICATIONS

U.S. Appl. No. 14/753,234, filed Jun. 29, 2015, Anthony William Shorey et al.

(Continued)

*Primary Examiner* — James N Smalley
(74) *Attorney, Agent, or Firm* — Kevin C. Johnson; Steven W. Miller

(57) ABSTRACT

The present invention relates to a reservoir (10) for containing a liquid preferably for use with a hair removal and fluid application device (1). The reservoir (10) comprises at least one liquid compartment, and has at least one sealed edge (15) having two surfaces and at least one opening means (11), wherein said opening means (11) is releasably attached in-between said two surfaces of said sealed edge (15) and extends outwardly there from. Upon detachment of the opening means (11) from said reservoir (10) an opening (16) is formed in said sealed edge (15) to allow the fluid to be dispensed there from.

14 Claims, 11 Drawing Sheets

(51) Int. Cl.
*B65D 83/00* (2006.01)
*B65D 47/42* (2006.01)

(58) Field of Classification Search
USPC ..... 30/41; 222/153.05, 153.07; 220/801
See application file for complete search history.

(56) References Cited

U.S. PATENT DOCUMENTS 2,019,957 A * 11/1935 England ..... B26B 21/06 30/32
2,331,204 A 10/1943 Lehmer
3,492,723 A 2/1970 Mollica et al.
3,608,566 A 9/1971 Storandt
3,703,765 A * 11/1972 Perez ..... B26B 21/446 222/541.1
3,797,493 A * 3/1974 Saudek ..... B65D 75/68 206/438
3,895,437 A * 7/1975 DiBuono ..... B26B 21/44 15/244.2
3,985,146 A * 10/1976 Albach ..... A45D 27/00 132/289
3,991,758 A 11/1976 Möhrke et al.
4,791,723 A 12/1988 Jacobson
4,838,429 A 6/1989 Fabisiewicz et al.
4,888,868 A * 12/1989 Pritchard ..... B26B 21/446 132/289
5,274,922 A 1/1994 Elliott
5,564,190 A * 10/1996 Fleetwood ..... B26B 21/446 30/41
5,761,813 A * 6/1998 Frick ..... B26B 21/446 30/41
5,771,591 A 6/1998 Armbruster et al.
5,819,413 A 10/1998 Kerbrat
2004/0016126 A1 1/2004 deBlois
2004/0177518 A1 9/2004 Leventhal
2008/0063324 A1 3/2008 Bernard et al.
2011/0289776 A1 12/2011 Hawes et al.
2013/0145601 A1 6/2013 Burrowes et al.
2013/0145625 A1 6/2013 Xu et al.
2013/0145626 A1 6/2013 Xu et al.
2014/0197202 A1 7/2014 Soh et al.

FOREIGN PATENT DOCUMENTS

EP 0427889 5/1991
WO WO 2010/038243 4/2010
WO WO 2010/047992 4/2010
WO WO 2010/100634 9/2010

OTHER PUBLICATIONS

U.S. Appl. No. 14/753,257, filed Jun. 29, 2015, Anthony William Shorey et al.
PCT International Search Report with Written Opinion in corresponding International application PCT/US2015/038205 dated Aug. 17, 2015.

* cited by examiner

DISPOSABLE FLUID DISPENSING RESERVOIR

FIELD OF THE INVENTION

The invention relates to disposable fluid dispensing hair removal devices and reservoirs therefore which enable a consumer to conduct a hair removal process without the need for additional system components, which is low cost, simple to manufacture and convenient to use, particularly in the absence of a source of water and/or outside of a bathroom environment.

BACKGROUND OF THE INVENTION

Reusable hair removal devices which are also capable of dispensing a fluid are known in the art. Such devices typically include one or more fluid dispensing orifices through which the fluid is dispensed via the razor cartridge during the shaving process. The fluid is contained with a replaceable reservoir located in the handle and is activated by a push button. Such devices are complex to manufacture requiring many parts and are designed to enable the replacement of both the razor cartridge and fluid reservoir. For example see US2013/0145626, US 2013/0145625, US2013/0145601, and WO2011/130372.

Disposable hair removal devices whereby the razor cartridge cannot be replaced are also well known in the art. These devices are typically slightly less complex versions of reusable devices, for example by the removal of a pivot between the cartridge and handle, to thereby simplify and reduce the costs of manufacturing. Nevertheless, these devices are still considerably complex to manufacture.

Hence, there is still a need to provide a disposable hair removal device which also enables the dispensation of a fluid and thereby negates the need for a separate fluid container while reducing the complexity of the device and number of components thereof, to reduce the cost of manufacture. This is particularly desirable for hair removal processes which take place away from the consumers' home bathroom facilities such as while traveling and or in the absence of a convenient water supply. There is also a need to provide a device which is easy to effectively use for all body areas.

Attempts have been described in the art to provide disposable hair removal devices which also dispense a fluid. For example EP427889A describes a disposable razor with detachable gel packets secured to the razor handle whereby the packets can be removed from the razor, opened and the contents applied to the skin prior or after the shaving process. This device is not particularly convenient for the consumer as the packets require removal from the device and separate independent application of the fluid. DE 102011117590 describes a disposable razor comprising a removable container for a shaving gel. The shaving gel container is placed on the razor handle; the end is placed on the razor head. Upon applying pressure to the perforations on the container the container is opened to release the razor gel. This device is equally inconvenient to use as the consumer is required to attach the device to the razor.

US2004/0016126 describes a manually adjustable hair removal and skin lubrication device. The device has a U shaped body which can be manipulated to expel lubricant from the internal reservoir independently or simultaneously during the hair removal process. This device however requires a significant amount of manual dexterity in order to select the desired usage configuration and in particular, to consistently maintain the desired configuration in order to simultaneously dispense the lubricant and control the razor cartridge during the entire shaving process. The consumer is therefore required to continuously check the configuration and this is particularly inconvenient as it results in an interruption of the shaving process and is impractical when shaving more inaccessible body areas. Moreover, the lubricant and wicking device are not sealed prior to use and thereby are liable to inadvertent spillage and or contamination.

Despite the availability of fluid dispensing razors, many consumers however still prefer to apply a skin preparation treatment onto the skin prior to the shaving process even if using a liquid dispensing razor. Liquid dispensing razors typically dispense the liquid directly below or above the razor blades or from within the razor cartridge through the razor blades. Consequently, the consumer may not be able to visibly confirm that the liquid has been dispensed on the skin surface to be shaved. The use of the pre-shaving preparation reassures and confirms to the consumer that there is complete and thorough coverage of the skin with the skin preparation prior to shaving. Moreover, the skin is hydrated and lubricated prior to shaving which improves the shaving experience. Similarly, the removal of the composition from the skin following the shave provides an indication to the consumer as to which areas have been shaved.

In order to access the fluid in such fluid dispensing devices, the fluid reservoir must be opened and or activated. For a complex system this is usually achieved by the use of a push button in the handle. However such systems are not desirable for disposable products primarily for cost reasons and a simpler system is required. The prior art related to disposable products on the other hand requires the consumer to access the reservoir manually which may require its entire removal from the device, the reservoir to be opened and then subsequently re-inserted into the device. Such a process is inconvenient, again requiring a degree of manual dexterity and potentially messy, as once open the fluid contained in the reservoir or sachet may be inadvertently expelled over the consumer, reservoir, and or the device. This may also prevent its correct re-insertion into the device and or cause leakage during use. While there are many sachet opening means described in the art such as simple tear tabs, frangible seals, tear strings or tabs, these all require the consumer to access and hold the sachet in order to open it; see for example U.S. Pat. No. 3,608,566, U.S. Pat. No. 4,838,429, US2008/0063324 and WO2012/091674. U.S. Pat. No. 3,991,758 describes a pharmaceutical single dose container, having an elongated flexible closure member extending through the wall of the container. Moreover, none of the art ensures a specific opening location and size to ensure controlled liquid dispensing particular for use in a consumer device.

Consequently, there still exists a need to provide an effective fluid reservoir preferably for use with a disposable hair removal device which enables the application of a desired composition such as pre shave or post shave composition in a simple and convenient manner. In particular, there is a need for a reservoir which is easy to use and does not require any manual dexterity or deconstruction of the device in order to open and activate fluid dispensing and which can be opened without requiring direct access to the reservoir and which can be used for all body areas.

SUMMARY OF THE INVENTION

The present invention relates to a reservoir (1) for containing a liquid preferably for use with a hair removal and fluid application device, comprising at least one liquid compartment, said reservoir having at least one sealed edge (15) having two surfaces and at least one opening means (11), wherein said opening means (11) is releasably attached in-between said two surfaces of said sealed edge (15) and extends outwardly there from, whereby said opening means (11) forms an opening in said sealed edge upon detachment from said reservoir (10).

In a further aspect, the invention relates to a hair removal and fluid application device comprising said reservoir, preferably comprising a hair removal means, fluid application means, and a support body, wherein said opening means extends from said reservoir through said fluid dispensing means.

FIGURES

FIG. 1*a* is a front view of one embodiment of the invention, the reservoir having a rectangular main body and a single tab opening means extending from at least one sealed edge.

FIG. 1*b* is a cross sectional view of the embodiment of FIG. 1*a* upon removal of the single tab opening means.

FIGS. 2*a* and *b* are a cross sectional view of a second embodiment of the invention the reservoir having a main body portion and a neck portion, wherein the at least one sealed edge is positioned in the neck portion and a single tapered opening means extends there from and b) showing its removal from the reservoir.

FIG. 3 is a front sectional view of a third embodiment of the invention, the reservoir having a main body and a neck portion, wherein the at least one sealed edge is in the neck portion and wherein the distal end and the proximal end form one loop extending outwardly from the sealed edge and another loop within the interior cavity of the reservoir.

FIGS. 4*a*, 4*b*, 4*c*, and 4*d*, show front views of various body and neck portion configurations with a single tab opening means.

FIGS. 5*a* and 5*b* are a cross/front view of a fourth embodiment of the invention having a main body and a neck portion. FIG. 5*a* illustrates a single tapered tab located between the two surfaces of the sealed edge in the neck portion whereas FIG. 5*b* illustrates a single tapered tab located in between the two surfaces of the sealed edge in the body portion of the reservoir.

FIG. 6 is a front view of various configurations of a single tab opening means.

FIGS. 7*a*, 7*b* and 7*c* are a front view of a fifth, sixth and seventh embodiment of the invention having a main body and a neck portion, wherein the opening means is a string or thread wherein the distal end of the opening means forms a loop on the distal portion of the opening means and wherein the proximal end extends into the interior cavity of the reservoir.

FIG. 7*a* shows a ring at the distal end, FIG. 7*b* shows a knot and FIG. 7*c* shows a tag.

Figures 1A, 1B:
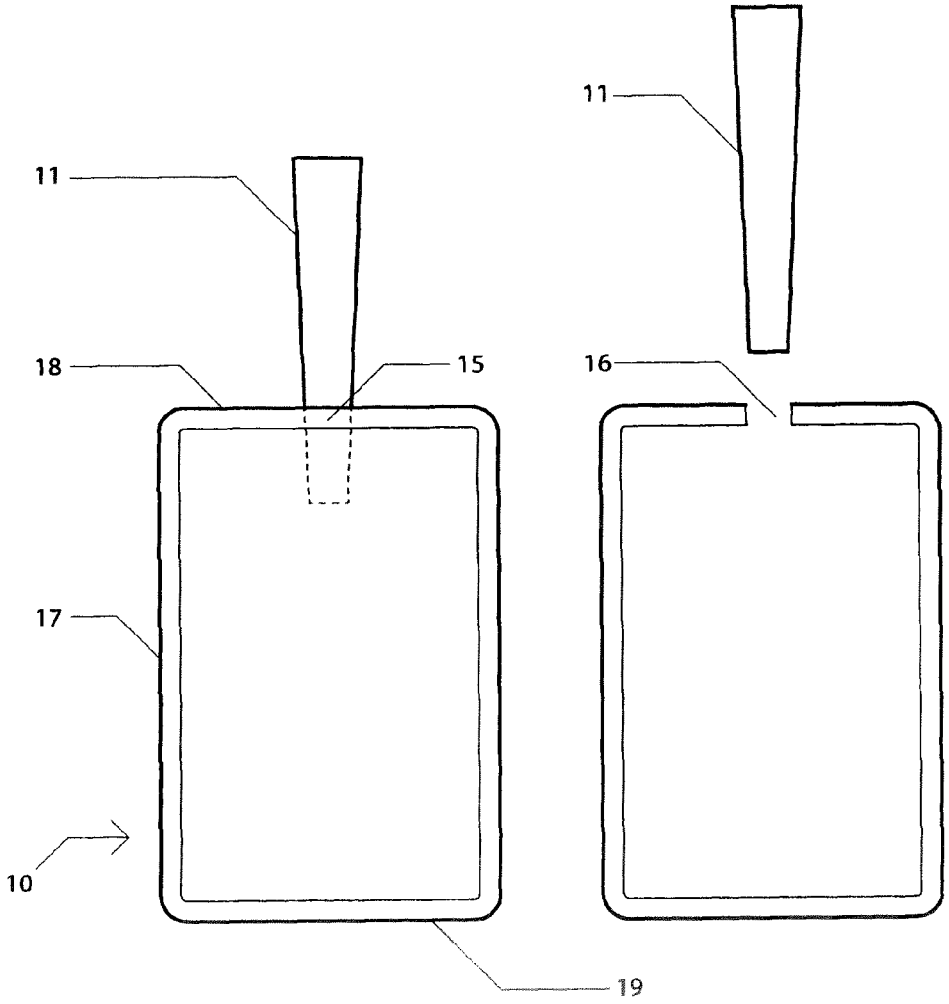
Figure 2A:
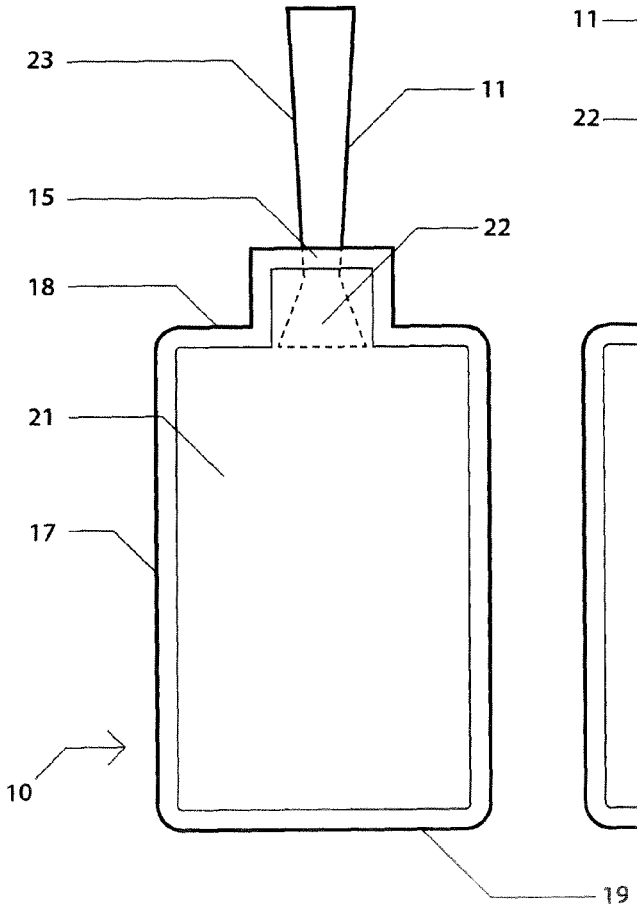
Figure 2B:
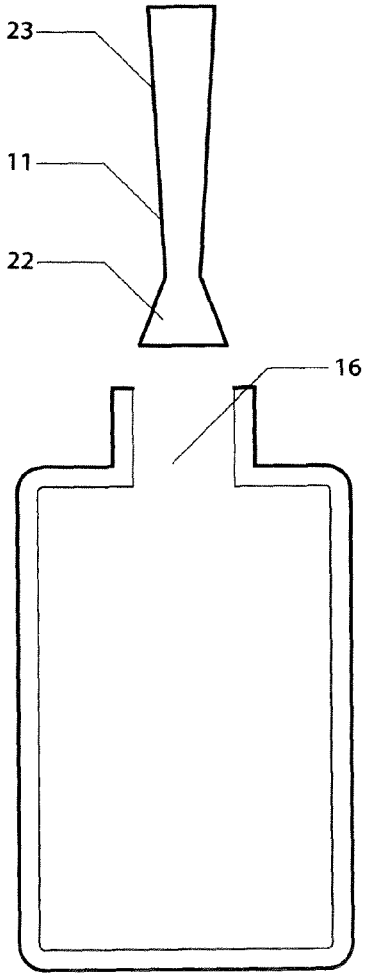
Figure 3:
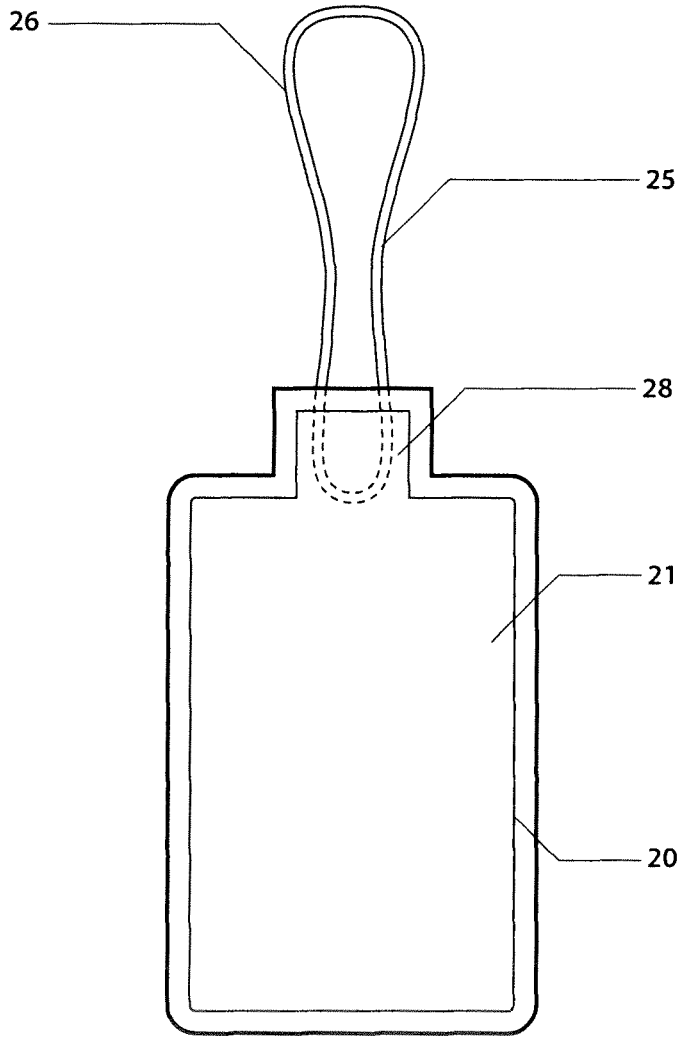
Figure 4A:
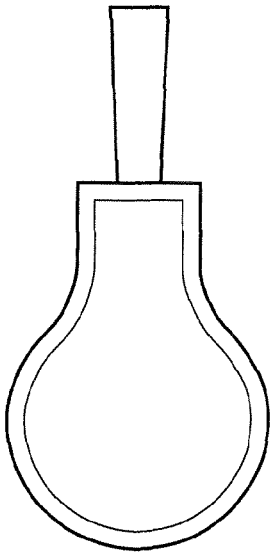
Figure 4B:
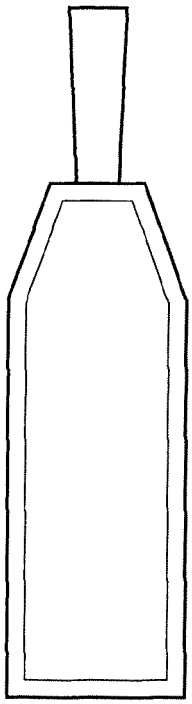
Figure 4C:
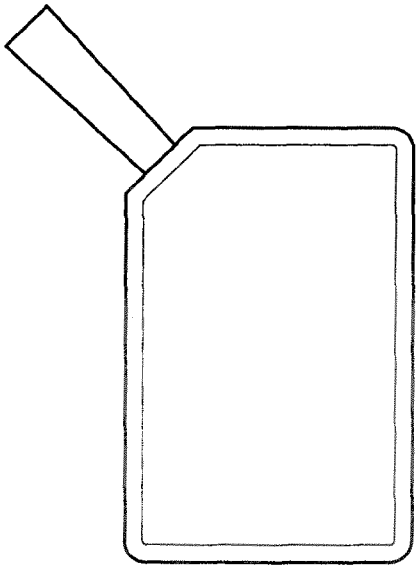
Figure 4D:
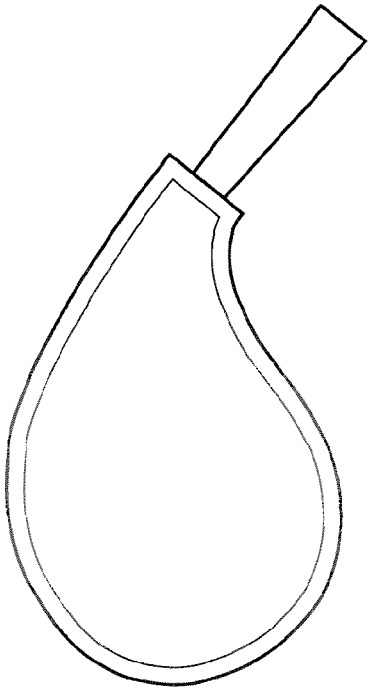
Figure 5A:
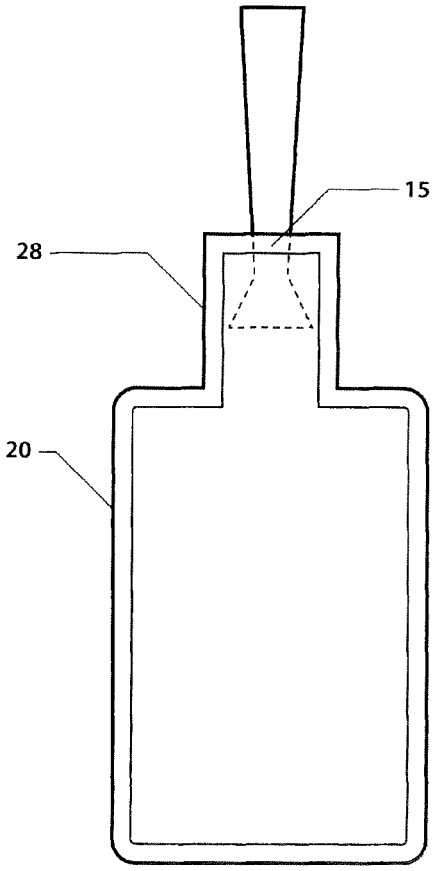
Figure 5B:
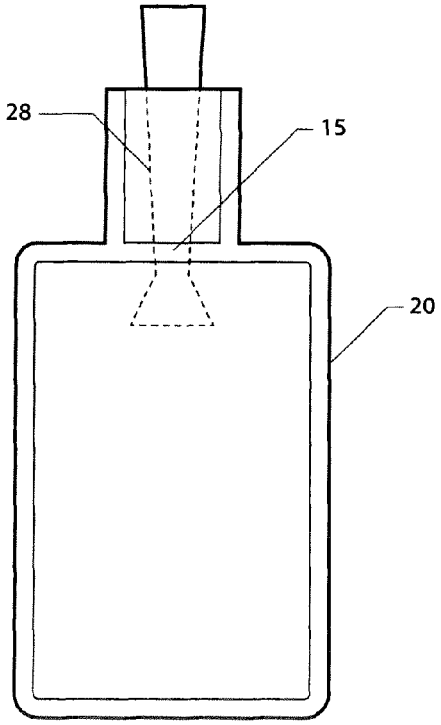
Figure 6:
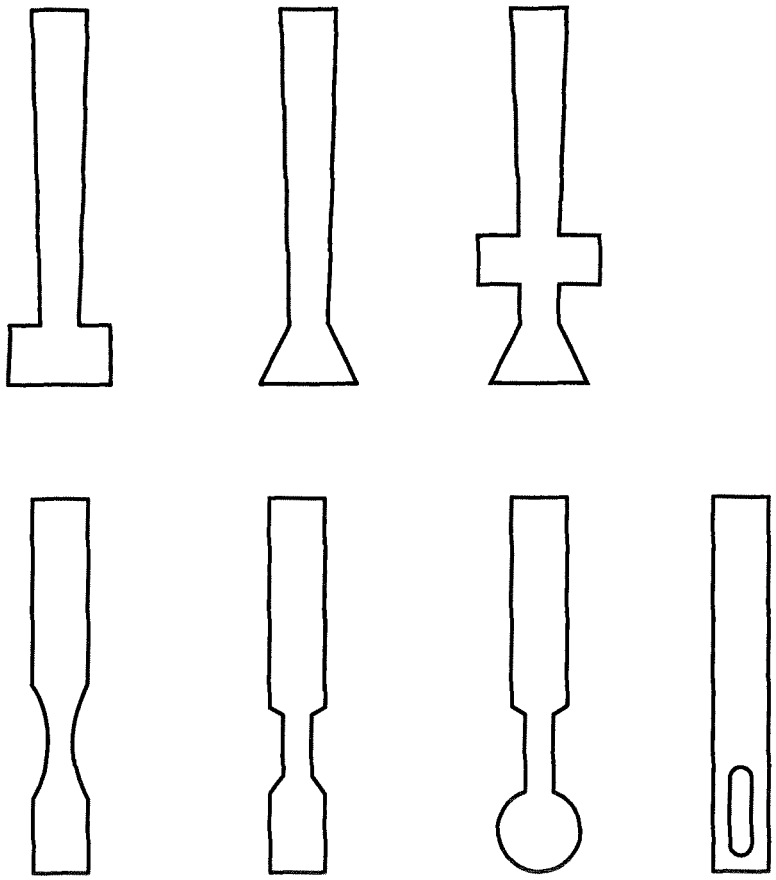
Figures 7A, 7B, 7C:
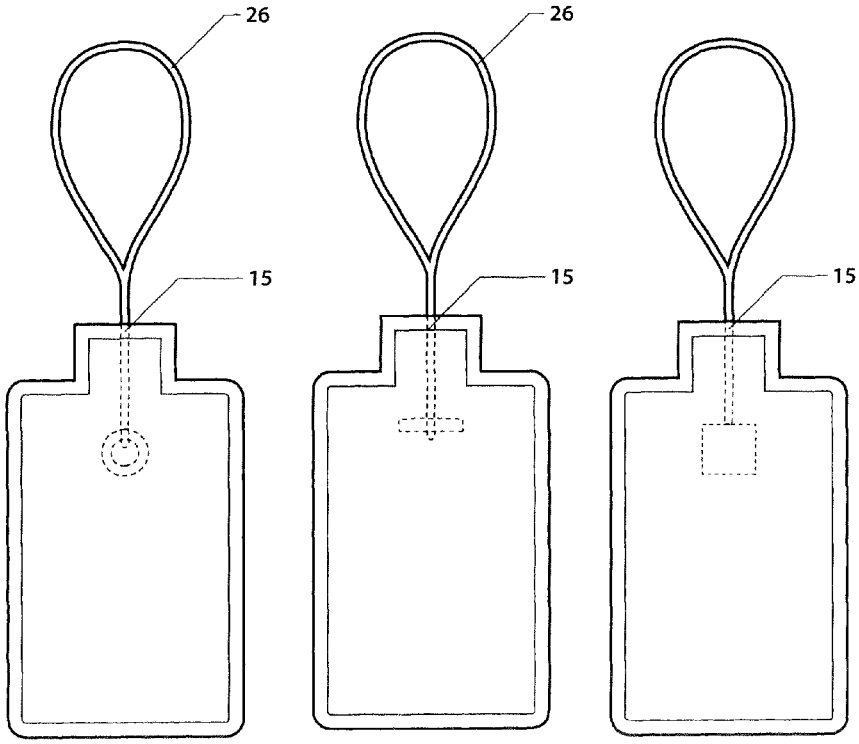
Figure 8:
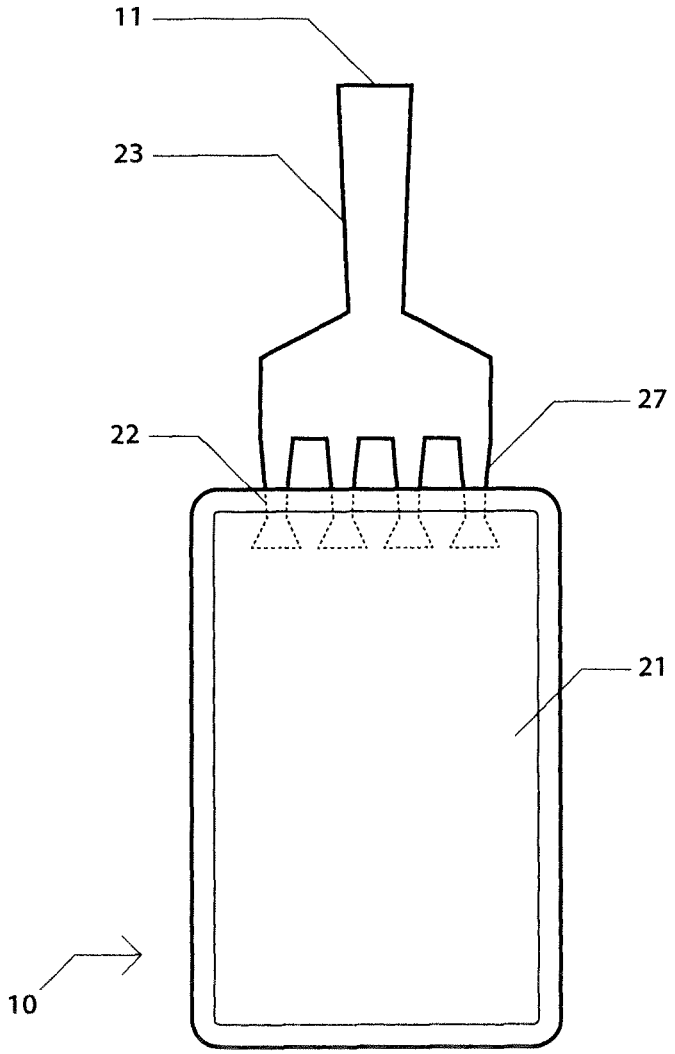
FIG. 8 is a cross section of an eighth embodiment of the invention having a main body portion and an opening means having tines extending into the interior cavity of the reservoir.
Figure 9:
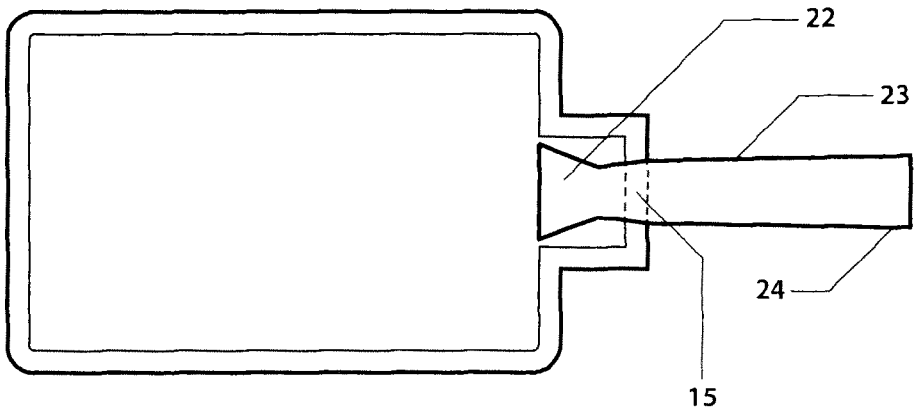
FIG. 9 is an enlarged cross section of embodiment of FIG. 2*a*.
Figure 10B:
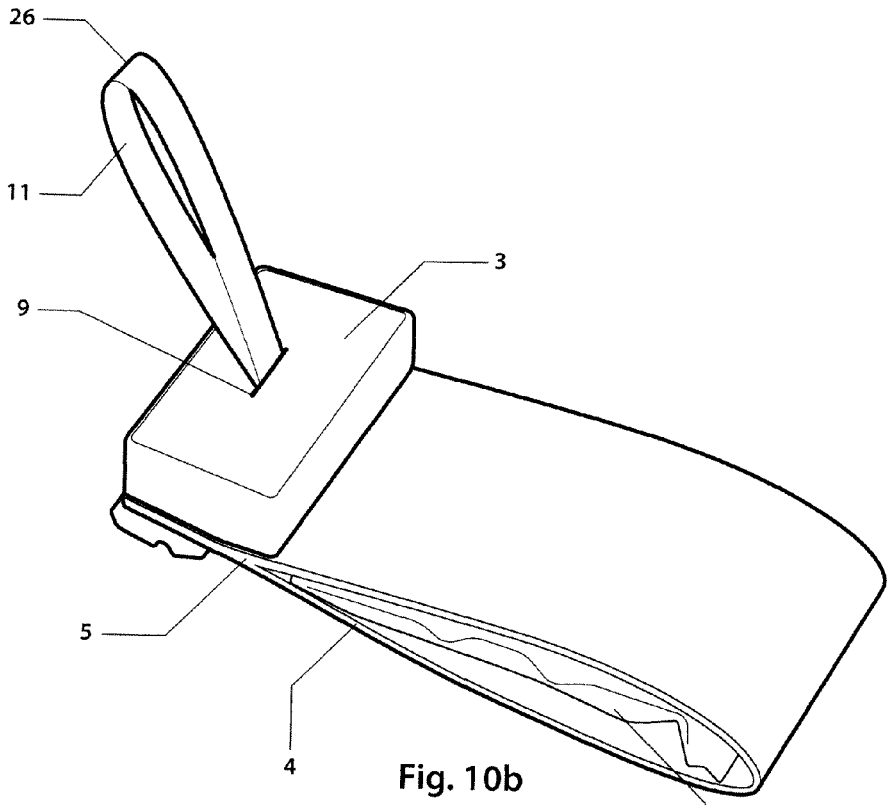
Figure 10A:
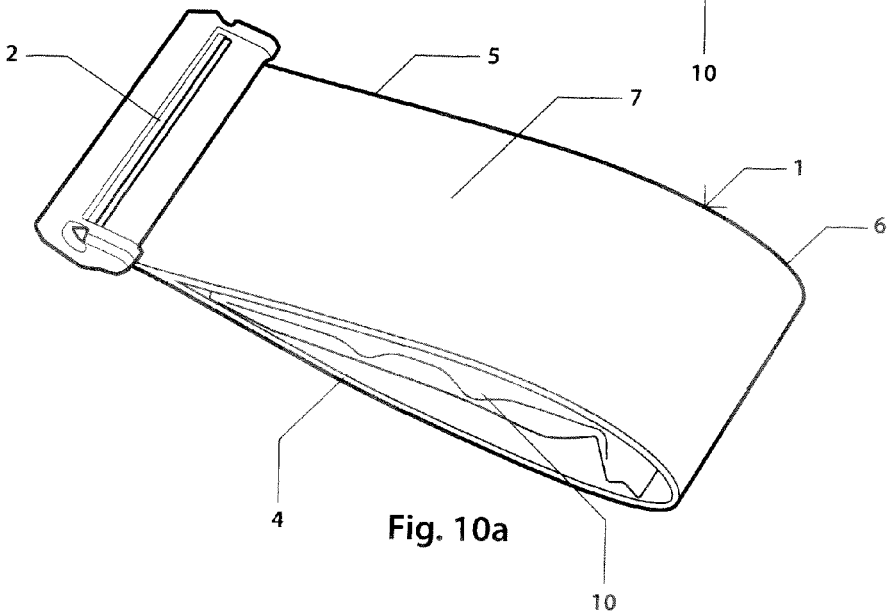

FIGS. 10*a* and 10*b* are a front and rear perspective view of a hair removal and fluid dispensing device having a reservoir and opening means of the invention.

Figure 11:
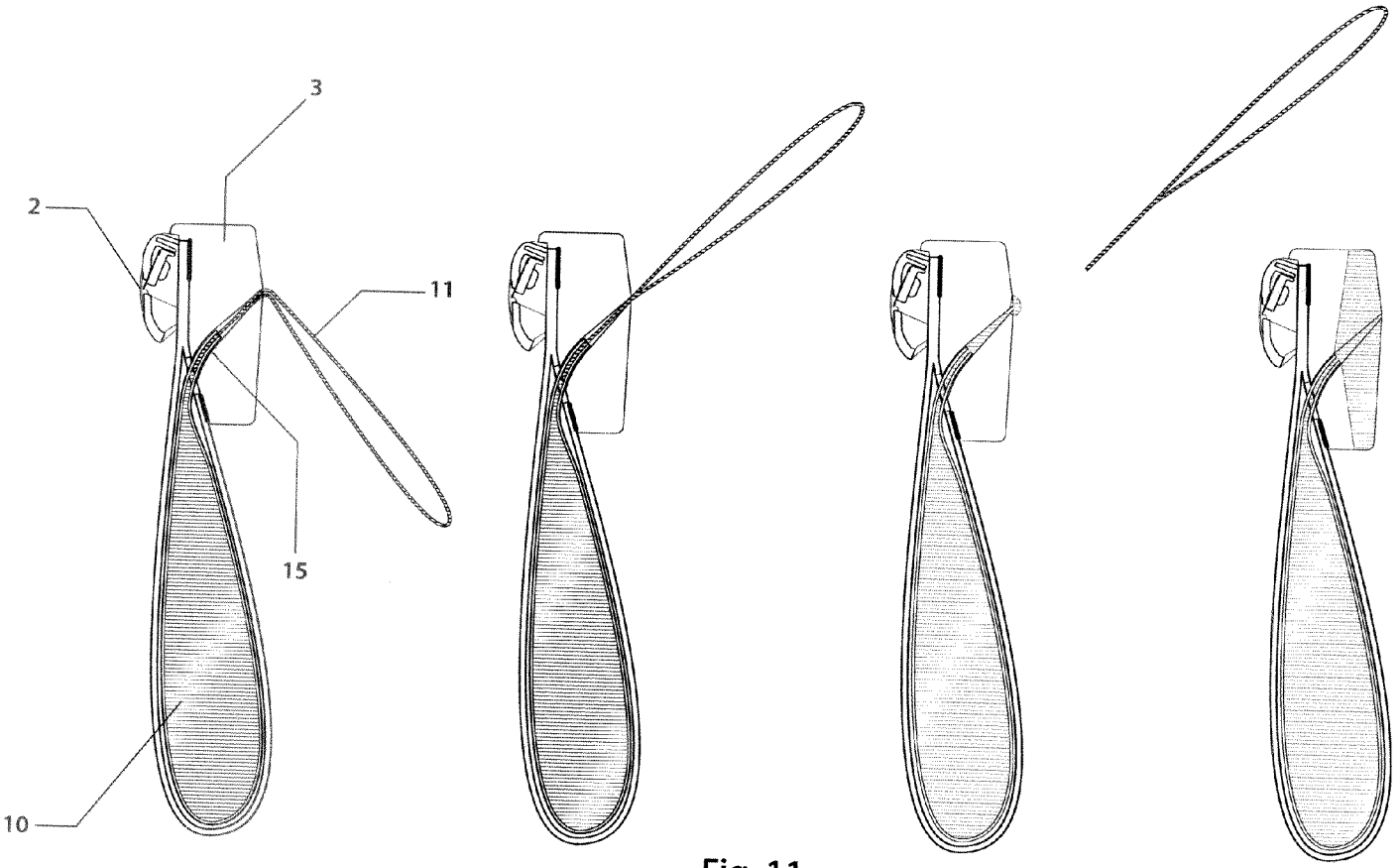

FIG. 11 is a schematic view of the process to open the reservoir of the device of FIG. 10.

DETAILED DESCRIPTION OF THE INVENTION

Reservoir

The present invention relates to a reservoir (10) to contain fluids having an opening means (11). The reservoir (11) of the invention may be any suitable reservoir to contain fluids. Preferably the reservoir is a flexible reservoir for containing fluids which facilitates the expulsion of the fluid from the reservoir upon the application of pressure by the user. The reservoir is provided with at least one sealed edge (15) having two surfaces and an opening means which is releasable attached in between said two surfaces and extends outwardly there from. Upon removal of said opening means by the user, an opening is formed in the sealed edge to enable the user to dispense the fluid contained in the reservoir.

The reservoir typically has major front and back surfaces and at least one side edge (15), preferably the reservoir has two side edges (17) and a top (18) and a bottom edge (19). The edges may define the perimeter of the reservoir. The edges are preferably linear but may exhibit a degree of curvature for example at the respective corners. The fluid reservoir has a main body portion which contains the fluid. The at least one sealed edge (15), is preferably located on the top edge of the reservoir (18).

The fluid reservoir may be provided from any material or combination of materials suitable to contain a fluid i.e. liquid impervious materials or composites. In one embodiment the reservoir is formed from a polymeric film such as plastic films, and or laminated plastic films or composite materials such as for example: PET/VMPE, PET/Foil/PE (preferably metal foils for example aluminum), PET/LLDPE, PET/PE-EVOH-PE, or SURLYN™ or other commercially available materials which are preferably capable of being sealing, preferably by heat sealing techniques. The laminate films may be formed by any method known in the art such as heat, pressure, and or adhesive. The material may be selected depending on the capacity of the reservoir and the density and the volume of the fluid to be contained therein and the strength and flexibility required for the particular application. The material may be transparent or opaque; the latter may have particular application to prevent fluid degradation. The outer surface of the reservoir or at least a portion thereof such as the major front or rear surface(s) or portion thereof, may be coated with an additional material to provide a consumer preferred tactile surface such as a woven, non woven, and or polymers such as silicone and rubber. The outer surface may also be provided with indicia to communicate to the consumer information such as the contents of the reservoir, usage instructions and or recommended handling position to hold and dispense the fluid.

The reservoir may be formed from a single sheet of material, which is folded and sealed, preferably heat sealed, at the top and bottom end edges and one side edge to form the reservoir. Optionally the second may be sealed to form a perimeter seal. In another embodiment, the reservoir may be formed from at least two sheets of material sealed along all the top, bottom, and side edges to form the reservoir. The edges of the reservoir are preferably substantially linear but may be partially curved. The reservoir may be sealed along all of its perimeter edges. Alternatively the reservoir may be formed by extrusion or blow molding techniques and may comprise one single sealed edge and no additional perimeter edge seals. The reservoir may be of any shape but is typically substantially rectangular, square, oval or circular, preferably substantially rectangular.

The reservoir may comprise one or multiple i.e. two or more separate fluid compartments to enable different compositions to be applied and or to enable multiple applications of the same or similar fluid composition(s). Each separate fluid compartment will preferably have an opening means or tab associated with the reservoir as described hereinafter. The multiple compartments may be provided by forming a reservoir having one compartment which is divided into 2 compartments by the provision of an additional seal.

At Least One Sealed Edge

The fluid reservoir of the invention comprises at least one sealed edge (15) having two surfaces which are sealed together using any method known in the art such as adhesive, heat sealing and pressure sealing. As discussed hereinafter, an opening means is located between at least a portion of said two surfaces of said sealed edge (15) to enable the sealed edge to be ruptured upon removal of the opening means there from. The resultant opening (16) is determined by the dimensions of the opening means (11) and will depend upon the end use of the reservoir and the size thereof.

Capacity

The capacity of the fluid reservoir is selected dependent upon the end use and intended usage regime, in other words whether it is intended for single use or multiple use. For beauty and grooming applications, the fluid reservoir may have a capacity of from about 1 ml to 500 ml, preferably from about 1 ml to 100 ml, more preferably from 1 ml to 15 ml or from 10 ml to 25 ml. The fluid reservoir is typically filled to at least about 75%, preferably at least about 80% capacity to prevent inadvertent spillage upon opening.

Opening Means

The fluid reservoir is further provided with an opening means or tab (11) to open the sealed edge (15) of the reservoir (10). The opening means or tab (11) may be readily grasped by the consumer, typically at its distal end (23) or by the tag, if present, to initiate the opening process. Typically, the consumer will pull on the opening means (11) generally in a direction away from the reservoir and thereby rupture a portion of the sealed edge to create an opening upon removal or partial removal of the opening means there from. The fluid contained in the reservoir may then be dispensed by the user.

Accordingly, the opening means (11) is releasably attached in-between the two contacting surfaces which are sealed to provide the at least one sealed edge (15) and extends outwardly there from. The opening means or tab has a proximal end (22) and a distal end (23). At least a portion of the proximal end (22) is releasably attached in between the two contacting surfaces of the sealed edge and the distal end (230 extends outwardly there from. Any means may be used to releasably attach the opening means (11) to the two surfaces of the sealed edge (15) including but not limited to adhesives, heat and pressure sealing, heat sealing being preferred. The opening means (11) is typically positioned in-between the two adjacent surfaces prior to sealing to form the sealed edge (15) as discussed hereinafter. The sealed edge containing the opening means is preferably provided in the top sealed edge (18) of the reservoir (10).

The opening means (11) may be provided from any suitable material such as the same or different material or film used for the reservoir material as described hereinabove. Suitable materials include but are not limited to metal, cotton, polymers such as polyester, nylon, rayon, plastics, cellulose based materials such as cardboard and paper which may be laminated, coated or waxed. The opening means may be flexible or rigid.

The opening means may have any suitable size, shape and geometry provided that it can be releasably attached in between the two surfaces of the sealed edge and can be easily grabbed by the fingers of the consumer. Preferably the opening means is substantially flat. For beauty and grooming applications, the opening means or tab may have a width of from about 0.1 mm to 2.5 cm, preferably from about 0.5 mm to 1 cm and a length of from about 1 cm to 15 cm, preferably from about 2 cm to about 10 cm. Alternative applications may however require dimensions of from 2 cm to 10 cm in width and 10 cm to 50 cm in length. The distal end of the opening means, which extends from the seal and is clearly visible to the consumer, may be symmetrical or unsymmetrical, uniform or non uniform cross section.

The opening means (11) may comprise a single tab (24), string or thread (25) which extends from said at least one sealed edge (15) and terminates at a point distal there from. Alternatively, the opening means may be a tab, string or thread which extends from said at least one sealed edge to form a loop (26). In such embodiments, the proximal end (22) of the loop (26) may be releasably attached at said at least one sealed edge (15). The distal end (23) may also be attached in-between the two surfaces of the sealed edge or attached at the exterior surface of the sealed edge or at the front or back surface of the reservoir or attached to a portion of the distal end (23) of the opening means (11). In one embodiment, both the proximal and distal ends (22, 23) are releasably attached in between the two surfaces of the sealed edge (15). In one embodiment, the tab may be provided with at least 2, preferably at least 3, more preferably at least 4 tines (27), in at least a portion of the proximal end (22) of the opening means (11). The tines may be present in the portion of the proximal end in between the two surfaces forming the sealed edge and may extend into the interior cavity (21) of the reservoir (10). The tines (27) if present may also extend into a portion of the distal end. The tines may assist in the creation of a more uniform opening or where desirable the creation of more than one opening upon removal of the opening means from the reservoir. Such multiple openings may assist in a more uniform distribution of the fluid upon dispensing from the reservoir onto a surface.

For embodiments where the opening means or tab terminates at a point distal from the sealed opening, the tab may further comprise a tag attached thereto. The tag is preferably substantially wider than the distal end of the opening means or tab to provide a larger surface area for the consumer to grasp and subsequently pull and remove or at least partially detach the opening means from the sealed edge. In an alternative embodiment, the tag may be in the form of a loop attached to the distal end of the opening means to enable the consumer to grasp and pull on the opening means. The tag may be any shape and preferably have a width or diameter of at least 0.1 mm, preferably at least 2 mm, more preferably at least 5 mm, even more preferably from 2 mm to 40 mm, most preferably from 5 mm to 20 mm. The width may be uniform or it may be tapered. For embodiments wherein the distal end of the opening means is in the form of a loop, such a tag may be provided at substantially the midpoint of the loop to provide additional assistance to the consumer to grasp the opening means. For embodiments wherein the opening means is a string or thread, the tag may be formed by providing a knot or loop at the distal end of the opening means. The tag may be provided from the same or different material as the opening means. In one embodiment the tag is formed from a different material preferably so as to provide a consumer preferred tactile surface.

The opening means or tab may be provided in an unfolded or folded configuration, which may be held in place by the tab if present and is unfolded prior to use.

The opening means or tab and/or tag may be provided with indicia to indicate to the consumer, the location of the tab, and/or the preferred gripping location and/or the direction to pull the means or tab to open and at least partially detach or remove the tab from the reservoir. Indicia may be in the form of differentiated colors and or symbols.

A portion of the proximal end (22) of the opening means or tab (11) may extend beyond the at least one sealed edge (15) into the interior cavity (21) of the reservoir (10). Such embodiments may further ensure the attachment of the opening means in between the two surfaces of the sealed edge. The opening means or tab located in the interior cavity of the reservoir may have the same or different shape as the distal portion of the opening means or tab which extends outward from the reservoir. In one embodiment, the portion of the proximal end which extends into the cavity of the reservoir is in the form of a loop, knot, or ring. In such embodiments, the distal end of the opening means extending from the sealed edge may or may not also be in the form of a loop.

The portion of the proximal end of the opening means that extends into the interior cavity of the reservoir may be attached or partially releasably attached to the interior surface of the reservoir.

For embodiments wherein the opening means is a loop, the distal portion may also extend into the reservoir interior.

In one embodiment, the portion of the proximal end (22) of the opening means or tab in the interior cavity (21) of the reservoir (10) has a width which is larger than the portion of the proximal end (22) of the opening means (11) in between the two surfaces at the sealed edge (15). Alternatively, the portion of the proximal end (22) of the opening means (11) in the interior cavity (21) may be larger than the distal portion (23) of the tab extending outward from the sealed edge. While not being bound by theory it is believed that increasing the width of portion of the proximal end (22) of the opening means (11) in the interior cavity (21) of the reservoir results in a greater force being exerted upon the sealed edge (15) as the consumer pulls on the distal end (23) of the opening means (11). This thereby further improves the opening of the seal upon removal or partial removal of the opening means (11) from the reservoir and optionally also may remove any debris present such as adhesive. The portion of the proximal end of the opening means or tab which extends into the interior cavity of the reservoir may be provided from a different material to that portion in-between the edge seal or the proximal end extending outward there from. The material will be selected to be inert towards the fluid contained within the reservoir. For embodiments wherein the distal end is provided by a string or thread, the width may be increased by the provision of knots or at least one tag.

In another embodiment, the opening means (11) or tab may be tapered in at least a portion, preferably all of the distal and/or proximal ends (23, 22). The opening means (11) may be tapered at least in the portion of the proximal (22) end (23) releasably attached in between the two surfaces of the sealed edge (15). The opening means (15) may therefore have a width in a portion of the proximal or distal (22, 23) end that is larger than the portion of the proximal end (22) of the opening means (11) positioned between the two surfaces forming the sealed opening. Similarly, a portion of the proximal end (22) of the opening means (11) may have a width which is larger than the width of the portion of the proximal end (22) positioned between the two surfaces of the sealed edge (15). The tapering may be linear or curved so as to provide an hour glass or arrow head shape for example. This is of particular advantage for embodiments wherein the proximal end extends into the cavity (21) of the reservoir. Upon exertion of force to remove the opening means the portion of the proximal end (22) thereof located in the reservoir cavity (21) having a width larger than the width of the portion of the proximal end (22) located in between the two surfaces of the sealed edge (15) will be forced against the sealed edge and cause the seal to be ruptured, thereby creating an opening (16) and or enlarging an opening(s).

The opening tab may be positioned at any position along the at least one sealed edge. Preferably the opening tab is located at substantially the midpoint of said sealed edge, but may be located at a position to the left or right of the midpoint or at or towards the corner of the sealed edge.

In one embodiment wherein the opening means or tab is provided in the form of a loop (26) wherein the distal and proximal ends (23,22) are releasably attached in between the two surfaces of the sealed edge (15), the opening means (11) and reservoir (10) are preferably provided from the same or substantially similar material as the reservoir. Such material may preferably be provided with different properties for each surface which may be readily provided by laminate materials to enable heat sealing. The outer surface of loop laminate which contacts the inner surface of the sealed edge is selected such that it will weakly adhere to the surface of the laminate film of the reservoir at the sealed edge. While not being bound by theory, it is believed that this results in a seal that requires less force to be opened upon removal or partial removal of the opening means upon the application of force. This is particularly advantageous for multi-layered composite films, for example (PET/VMPE) and other commercially available films.

In addition to releasably attaching a portion of the proximal end of the opening means in between the two surfaces of the sealed edge, a portion of the distal or proximal end of the opening means may have at least one additional attachment, preferably a releasable attachment to the reservoir. Such an attachment may be on an external or internal surface of the reservoir. Embodiments wherein the opening means and/or the reservoir utilize laminate materials utilizing adhesives in their manufacture this may find particular utility to form such an attachment. While not bound by theory it is believed that the adhesive may seep from the laminate particularly due to the application of heat and/or pressure around the perimeter sealed edges and/or edges of the opening means and thereby result in additional attachment.

Neck Portion

In one preferred embodiment, the reservoir comprises a main body (20) which is further provided with a neck portion (280 extending there from. The presence of a neck portion (28) enables improved fluid flow control and may also enable improved connection with the device to which the reservoir may be attached. The at least one sealed edge (15) may be located in the body portion (20) of the reservoir or it may be located in the neck portion (28). Preferably the at least sealed edge (15) is located in the neck portion (28), if present. The top and side edges of the reservoir if present will extend from the body to neck portion respectively.

The neck portion is preferably located substantially at the midpoint of the width of the body portion extending from the top edge thereof. Alternative configurations include embodiments where the neck portion is offset from the midpoint or located towards one of the upper corner edges of the body portion. The neck portion may extend a length of up to 50% of the length of the side edge of the body portion. In such embodiments the side edges of the reservoir may extend from the body portion to form the side edges of the neck portion and similarly the top edge or a portion of the top edge of the reservoir may be located in the neck portion. Preferably the neck portion has a width less than the width of the body of the reservoir, preferably less than 75%, preferably less than 50%, more preferably less than 40% of the width of the body portion of the major front or rear surface of the reservoir.

The neck portion may have any suitable shape and may be symmetrical or unsymmetrical and is preferably selected to enhance the flow of fluid towards the opening. The neck portion may have substantially linear sides or curved sides which may be substantially vertical or at a gradient to provide a tapered neck which aids in the funneling of the fluid out of the reservoir.

It has been found that opening means formed from laminate materials which comprise an adhesive form an improved seal between the opening means and the reservoir, while not bound by theory, it is believed that the application of heat and/or pressure during the sealing process results in adhesive from the laminate being released and becoming mobile and thereby forming a bond between the opening means and reservoir edge.

Method of Manufacture

The reservoir may be manufactured using methods known in the art. Typically the reservoir is pre-cut into the desired shape including the neck portion if present from one or 2 laminate films. A portion of the proximal end of the opening means is positioned in between the two surfaces forming the sealed edge. The top and side edges are sealed. The reservoir is then inverted and filled from the bottom edge with fluid and subsequently the bottom edge is sealed.

Hair Removal and Fluid Dispensing Device

The fluid reservoir may find numerous applications to provide a convenient disposable source of a composition for beauty care and grooming applications. The reservoir finds particular utility for disposable hair removal and fluid dispensing devices (1). Such devices comprise a hair removal means (2), a fluid dispensing means (2), a fluid reservoir (10) as described herein, and a support body (4). The hair removal and fluid application device (1) may comprise an upper portion (5) and a lower portion (6), each respectively having an associated front and back surface (7, 8). In one embodiment, the opening means extends from said reservoir through said fluid dispensing means.

Hair Removal Means

Any hair removal means (2) known in the art may be used herein, such as single or multiple, i.e. at least two blades, or three blades and optionally an associated razor housing or cartridge there for; foil, scraper or mesh. Preferably, the hair removal means comprises a guard and a cap with at least one blade located in-between the cap and guard. More preferably, the hair removal means comprises a razor cartridge having a housing and a cap and a guard located on the housing and at least one blade positioned between the cap and guard. Embodiments of this type having a single blade cartridge are particularly beneficial as it allows shaving debris such as hair, skin, and shaving composition to readily pass through the cartridge and thereby prevent clogging.

Fluid Dispensing Means

Suitable fluid dispensing means (3) include any material capable of dispensing the fluid upon application of the means against a user's skin. The rate of dispensing can be readily controlled by the consumer by regulating the amount of pressure applied to the dispensing means against the user's skin.

Suitable materials include foams, including open and closed cell foams, wovens, nonwovens, single, or multiple perforated or apertured films, rigid or semi rigid molded plastic and combinations thereof. The fluid dispensing means may comprise a single layer or multiple layers of material which may be the same material or different. Such layered embodiments may be layered vertically on top of one another whereby each layer extends towards the surface facing the skin contacting surface or layered adjacent one another each layer directly facing the skin contacting surface.

Preferably, the hair removal means is provided by a foam, more preferably an open celled foam. Suitable materials include natural sponge, cellulose, polyethylene, polyurethane and other synthetic foam materials known in the art and commercially available. Foam materials are particularly advantageous as they may function to both retain, dispense and spread the fluid dispensed onto the skin, thereby enabling a more controlled application of the fluid onto the user's skin by the consumer.

In one preferred embodiment, the fluid dispensing means is selected such that it may also function as a post hair removal debris collector so that it will act to collect at least some of the hair and or fluid remaining on the skin after the hair removal process. Suitable materials for such embodiments include foams preferably open celled cellulose foams. Alternatively a combination of materials may be utilized in order to provide both fluid dispensing and debris collection. Suitable combinations include for example open and closed cell foams, or a foam and non woven sheet material composite.

The fluid dispensing means preferably has a skin contacting surface area of from about 0.8 $cm^2$ to about 35 $cm^2$, preferably from about 5 $cm^2$ to about 15 $cm^2$' more preferably from about 8 $cm^2$ to about 10 $cm^2$.

Support Body

The hair removal and fluid application means device further comprises a support body (4) to enable both a user to hold and control the device (1) and to securely locate and position the hair removal means (2) and the fluid dispensing means (3) in predetermined positions relative to one another. The support body typically has an upper portion (5) and a lower portion (6) and may have a major front (7) and back surface (8). The hair removal means and fluid application means may be positioned at any suitable location on the support body. Such positions include but are not limited to the hair removal means and fluid dispensing means both being located on the upper portion of the support body and/or both being located on the front or back surface of the support body. In one embodiment the hair removal means and the fluid dispensing means are located on opposing surfaces i.e. front and back surfaces respectively of the support body. This enables the hair removal means and the fluid dispensing means to be contained on a single device but used independently from one another without any interference. The hair removal means and the fluid dispensing means may be positioned such that they are substantially aligned about a horizontal plane. Alternatively, hair removal means and the fluid dispensing means may be offset with either the hair removal means being positioned at least partially above the fluid dispensing means or vice versa.

The fluid dispensing means and hair removal means are preferably independently secured to a portion, preferably the upper portion of the support body of the device. Suitable securing means include adhesives, ultrasonic welding, double sided tape, rivets, clips or other mechanical means and combinations thereof.

In one embodiment, the fluid dispensing means and or hair removal means independently extend along at least a portion, preferably at least 50% more preferably at least 75%, even more preferably at least 90%, most preferably at least 95% of the width of the front and or rear surface respectively.

In certain embodiments the fluid reservoir (10) may be attached to the support body at least on a portion of one of the internal or external surfaces thereof. Any suitable means to attach the reservoir may be used such as adhesives, ultrasonic welding, double sided tape, rivets, clips or other mechanical means and combinations thereof.

The support means preferably provides sufficient rigidity to the device to enable the consumer to hold the device and apply and dispense the fluid onto the skin or apply the hair removal device onto the skin.

The support body may be formed from any suitable material include natural and synthetically derived materials and combinations thereof including polymers, such as plastic, both rigid and semi rigid such as polystyrene, polypropylene, cellulose such as cardboard, paperboard, carton board and carrier board; nylon, rayon, cotton and combinations thereof. The support body is preferably formed from cardboard or a polymer, most preferably cardboard.

The support body may be provided as a single or multiple layers and or may be in the form of a scaffold, cage, mesh, lattice or skeleton configuration or combination thereof having openings therein while providing rigidity. The support body may be formed from any suitable cardboard, carrier board, carton board, paper board, or liquid packaging board. Such terms are used interchangeably herein. Such boards are typically produced from cellulose fibers such as wood or plant based pulp sources included recovered fibers or waste paper. The carton board may be single or multiply. The carton board may contain pigment coating such as clay, calcium carbonate, and titanium dioxide and/or may contain adhesives and or binders such as styrene butadiene.

The support body may preferably be surface treated on at least one major front and/or rear surface with a suitable water repellant material such as a wax or polymer(s) to improve consumer handling particularly in the presence of water and to improve the tactile feel or grip of the support body and to more readily enable printing. The material may have at least a portion which is corrugated. In one embodiment the carton board may be laminated to further improve wet strength. The support body may be formed from a single piece of material or from two or more pieces of material which are joined together using known means such as adhesive.

While not being bound by theory the use of carton board for the support body provides a number of advantages. Carton board can be readily incorporated into a manufacturing process without the need for expensive tooling and is readily cut to the desired shape. Moreover as discussed hereinafter the desired fold lines or score lines are also readily produced in carton board. Carton board further provides a desirable thickness to strength ratio and density to provide a strong but lightweight support body. Consequently, the carton board support body can provide the device with the desired degree of flexibility for improved consumer usage experience while maintaining sufficient rigidity so that the consumer can exert the desired force associated with the hair removal or fluid application process as exemplified hereinafter. The carton board for use herein may have a basis weight of from about 200 g/m$^2$, preferably from about 225 g/m$^2$, more preferably from about 250 g/m$^2$. The carton board may have a thickness of from about 0.25 mm, preferably from about 0.3 mm and or less than about 1.5 mm.

The support body may take any shape or configuration provided it is suitable to be held by the consumer and can secure the location of the hair removal means and the fluid dispensing. Suitable configurations include substantially U shape, V shape, diamond shape, S shape substantially flat, curved shape, and combinations thereof. The shape should preferably be ergonomic and enable easy handling by the consumer. In one embodiment at least a portion of the upper portion of the support body is substantially flat.

The support body may be provided within the fluid reservoir, integral with the reservoir or external thereto or partially enclose the reservoir. In one embodiment the support body means is external to the reservoir and partially encloses the reservoir either on the major front and/or rear surface or the vertical edges of the reservoir. The support body preferably does not entirely enclose the fluid reservoir during use. Such embodiments provide protection of the fluid reservoir from accidental rupture and enable the consumer to exert pressure onto the reservoir to expel the fluid contained therein via the support body.

In an alternative embodiment, the support body is contained within the reservoir. In such embodiments the support means will be selected so as to be inert to the fluid contained therein.

In one embodiment the support body may be substantially flat. The support body may be provided with predetermined fold lines (deformation lines) and/or score lines, typically positioned extending longitudinally in at least the lower portion or extending horizontally in the lower portion or a combination thereof. In one embodiment the fold lines are positioned at least in the upper portion and may extend substantially horizontally. In an alternative embodiment, the fold lines do not typically extend to the upper portion. The fold lines are preferably formed so as to enable the flat support body to form a 3D shape enabling the consumer to readily hold the device and/or to delineate or separate the hair removal means from the fluid dispensing means. Alternatively the fold lines may provide further structure to a preformed 3D support body and/or delineate or separate the hair removal means from the fluid dispensing means. The support body may have fold lines when formed within the reservoir or external thereto.

In an alternative embodiment the support body is provided with fold lines to enable the hair removal and fluid dispensing device to be folded up before and/or after use to a more convenient size. The fold lines may also be used to fold up the device so that the hair removal means and/or the fluid dispensing means are at least partially covered and thereby remain clean and free from contaminants and also to prevent inadvertent damage. This is of particular advantage if the device is carried by the consumer away from home.

The fold lines are preferably resilient such that the consumer can readily unfold the device before or after use.

In another embodiment the support body may be provided with predetermined fold lines to provide a degree of pivot motion preferably between the support body and the hair removal device and or fluid dispensing means without the need for a complex pivot unit. In an alternative embodiment the fold lines may separate the fluid dispensing means and the hair removal means from one another, this may facilitate opening the fluid reservoir and or improve handling of the device during use.

The reservoir may extend from the upper portion to the lower portion of the device and contains a fluid, paste, or gel. The reservoir may be permanently or releasably, directly or indirectly attached to the support body. Suitable attachment means include adhesive, Velcro, ultrasonic welding, double sided tape, rivets, clips or other mechanical means.

The reservoir preferably extends towards the fluid dispensing means and even more preferably extends at least a portion within or onto or through the support body and or fluid dispensing means and thereby creates a fluid pathway between the fluid reservoir and the fluid dispensing means. The opening means is typically located in the neck portion if present.

In a preferred embodiment the opening means (11) extends from the reservoir (10) through the support body (4) and/or fluid dispensing means (3) so that the opening means (11) can be readily accessed by the consumer. In such embodiments the fluid dispensing means may be provided with an opening (16) sized to enable the opening means to be passed through the fluid dispensing means as shown in FIG. 10.

FIGS. 10*a* and 10*b* show a hair removal and fluid dispensing device (1) of the invention. This embodiment comprises at least one razor blade (2) provided in a housing located on the upper portion (5) of the front surface (7) of the device. A fluid dispensing means (3) is located on the upper portion (5) of the back surface (8). The fluid dispensing means (3) comprises a sponge which extends substantially across the entire width of the back surface (8) of the upper portion (5). The hair removal means (2) and the fluid dispensing means (3) are arranged in a predetermined position such that they are located in opposing directions facing the respective skin contacting surface. The hair removal means (2) and fluid dispensing means (3) are secured to a support body (4). The support body (4) is formed from a single piece of carton board which may be coated with a water repellant material or laminated. The carton board is folded about its midpoint to form a U shape and the fluid reservoir (10) which comprises a laminated sheet is located therein so that the support body substantially covers the front and back surfaces of the fluid reservoir which is retained therein. The support body (4) is provided with an opening through which a portion of the reservoir is inserted to form a liquid pathway to the fluid dispensing means. The reservoir (10) is provided with a pull tab opening means (11) which extends from the reservoir (10) through the support body opening and through the fluid dispensing means (3).

Upon removal of the opening means (11), the fluid dispensing means (3) has at least one fluid pathway in fluid communication with said opening means and said reservoir allowing the fluid to be dispensed as shown in FIG. 11.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hair removal and fluid application device, said device comprising a front surface, an opposing back surface, an upper portion, an opposing lower portion, a fluid reservoir and a support body, said front surface of said upper portion comprises a hair removal means and said back surface of said upper portion comprises a fluid dispensing means, said fluid reservoir is positioned between said front surface and said back surface and in fluid communication with said fluid dispensing means, said reservoir comprising at least one liquid compartment, said reservoir having at least one sealed edge, having two surfaces and at least one opening means, wherein said opening means is releasably attached in between said two surfaces of said sealed edge and extending outwardly there from.

2. A hair removal and fluid application device according to claim 1, wherein said opening means has a proximal end and a distal end, wherein at least a portion of said proximal end is releasably attached in between said two surfaces of said sealed edge.

3. A hair removal and fluid application device according to claim 1, wherein at least a portion of said proximal end of said opening means extends into the internal cavity of said reservoir.

4. A hair removal and fluid application device according to claim 1, wherein said opening means is formed from a polymer, cellulose, metal, cotton, and combinations thereof, preferably a polymer or cellulose.

5. A hair removal and fluid application device according to claim 1, wherein said opening means is selected from a tab, thread, or string.

6. A reservoir according to claim 2, wherein opening means is in the form of a loop, wherein said distal end is releasably attached in between said two surfaces of said sealed edge.

7. A reservoir according to claim 3, wherein said proximal end of said opening means is in the form of a loop.

8. A reservoir according to claim 3, wherein at least a portion of said proximal end extending into the interior cavity of said reservoir has a width that is greater than the width of the portion of the proximal end of said opening means releasably attached in between the two surfaces of said sealed edge.

9. A hair removal and fluid application device according to claim 1, wherein a portion of the distal end of said opening means is tapered.

10. A hair removal and fluid application device according to claim 1, wherein a portion of the proximal end of the opening means is tapered.

11. A reservoir according to claim 1, wherein said opening means has an hour glass or arrow head configuration.

12. A hair removal and fluid application device according to claim 1, wherein said reservoir and said opening means are formed from laminated films, preferably the same laminate film.

13. A hair removal and fluid application device according to claim 1, wherein said reservoir comprises a body portion and a neck portion extending there from, wherein said at least one sealed edge is located in said neck portion.

14. A hair removal and fluid application device according to claim 1 wherein said opening means extends from said reservoir through said fluid dispensing means.

* * * * *